US006071869A

United States Patent [19]

Materniak et al.

[11] Patent Number: 6,071,869

[45] Date of Patent: Jun. 6, 2000

[54] FABRIC CLEANING FORMULATIONS

[75] Inventors: Joyce Monson Materniak, Hockessin, Del.; Charles Leonard Strickler, Elkton, Md.

[73] Assignee: E. I. du Pont de Nemours and Company, Wilmington, Del.

[21] Appl. No.: 09/252,291

[22] Filed: Feb. 18, 1999

Related U.S. Application Data

[63] Continuation-in-part of application No. 08/699,085, Aug. 16, 1996, abandoned.

[51] Int. Cl.[7] ..... C11D 3/00; D06B 3/10

[52] U.S. Cl. ..... 510/280; 510/299; 510/348; 510/400; 510/507; 510/528; 8/137

[58] Field of Search ..... 510/278, 299, 510/348, 400, 507; 8/137, 280, 528

[56] References Cited

U.S. PATENT DOCUMENTS

| | | | |
|---|---|---|---|
| 3,206,408 | 9/1965 | Vitalis et al. | 510/507 |
| 3,630,919 | 12/1971 | Sheaffer et al. | 510/278 |
| 4,043,923 | 8/1977 | Loudas | 510/507 |
| 4,219,333 | 8/1980 | Harris | 8/137 |
| 4,348,292 | 9/1982 | Ginn | 252/90 |
| 4,438,016 | 3/1984 | Kiewert et al. | 510/507 |
| 4,564,463 | 1/1986 | Secemski et al. | 252/174.17 |
| 5,209,857 | 5/1993 | Kenyon et al. | 510/507 |
| 5,330,672 | 7/1994 | Langer et al. | 252/108 |
| 5,439,610 | 8/1995 | Ryan et al. | 510/507 |
| 5,514,302 | 5/1996 | Brown | 252/545 |
| 5,534,167 | 7/1996 | Billman | 510/299 |
| 5,712,240 | 1/1998 | Tyrech et al. | 510/424 |

*Primary Examiner*—Jacqueline V. Howard

[57] ABSTRACT

This invention relates to aqueous cleaning formulations useful in the cleaning of textile fabrics such as carpets and upholstery. The cleaning formulations comprise a) detergent, b) fluorochemical soil-resist agent, c) stain-resist agent, and d) a stable aqueous dispersion of inorganic particulate matter selected from the group consisting of clay, colloidal silica, colloidal alumina, titanium dioxide, and mixtures thereof. The detergent, the fluorochemical soil-resist agent, the stain-resist agent and the inorganic particulate matter each have a flash point that is at least 100° C.

27 Claims, No Drawings

FABRIC CLEANING FORMULATIONS

CROSS-REFERENCE TO RELATED APPLICATION

This application is a continuation-in-part of application Ser. No. 08/699,085, filed Aug. 16, 1996, now abandoned.

FIELD OF THE INVENTION

This invention relates to fabric cleaning compositions of the type adaptable for use in the shampooing and cleaning of textile fabrics such as carpets, and more particularly to fabric cleaning compositions that inhibit resoiling and restaining after cleaning.

BACKGROUND OF THE INVENTION

Fabric cleaning formulations have been previously developed and employed in the cleaning of textile fabrics, including upholstery, leather and pile, fabrics of the type normally found in carpets and rugs. Many of the prior fabric cleaning formulations involve the use of detergent materials in aqueous or solvent mediums, in which dirt and soil are removed by normal detergent action. Others involve formulations which are applied dry or damp to the fabric surface. Soil and dirt particles are, in effect, loosened by mild detergent action. Loosened particles are then adsorbed on particles of filler material and thereafter vacuumed from the fabric.

A disadvantage to many of the previous cleaning formulations is the tendency of the shampooed area to resoil or restain soon after cleaning. In many instances, residue from fabric cleaning formulations of the prior art seem to attract soil and stains to the cleaned textile fabric.

Others have tried to solve this resoiling problem by modifying fabric cleaning compositions with additives to prevent resoiling such as various types of fluorochemicals. See, for example, U.S. Pat. Nos. 4,043,964 (Sherman et al.); 4,279,796 (Tarkinson); 5,338,475 (Corey et al.); 5,395,555 (Colurcciello et al.). Still others have modified fabric cleaning compositions with stain resist agents, such as styrene maleic anhydride, methyl/methacrylate, methacrylic acid and the like. See, for example, U.S. Pat. Nos. 3,716,488 (Kolsky et al.); 3,722,323 (Morgan et al.); 3,779,929 (abler et al.); 3,835,071 (Allen et al.); 4,203,859 (Kirn et al.); 4,566,980 (Smith); 4,678,595 (Malik et al.); 4,908,149 (Moore et al.).

Still others have modified fabric cleaning compositions with inorganic particles such as clays, silicas and alumina to improve resoiling. See, for example, U.S. Pat. Nos. 3,716,488 (Kolsky et al.); 3,736,259 (Buck et al.); 4,035,148 (Metzger et al.); 4,090,974 (Morganson); 4,566,980 (Smith); 4,581,385 (Smith); 4,873,000 (Weller). While all of these modifications improve resoiling or restaining vs. the unmodified fabric cleaning formulation, there is still some degree of resoiling or restaining.

Others have tried to solve this problem by combining soil resist agents and stain resist agents in a single fabric cleaning formulation. See, for example, U.S. Pat. Nos. 3,901,727 (Loudas); 4,043,923 (Loudas); 5,073,442 (Knowlton et al.); 5,212,272 (Sargent et al.); 5,439,610 (Ryan et al.); and Japanese Kokai 56-129281. Resoiling and restaining are further improved, but there is still room for improvement. Furthermore, it would be advantageous if once textile fabrics were cleaned that they resisted resoiling and restaining better than they had resisted soiling or staining prior to cleaning.

Certain of the prior art, particularly U.S. Pat. Nos. 4,043,923 (Loudas) and 5,439,610 (Ryan et al.), attempt to achieve a stable product formulation among incompatible components (such as fluorochemical emulsions and inorganics) through the use of organic solvents. However, the presence of organic solvents is believed deleterious since these materials are flammable, have the potential to irritate the skin of cleaning personnel, and detract from air quality when used indoors.

Accordingly, it is an object of this invention to provide an improved textile fabric cleaning composition which imparts to the fabric improved soil and stain-resistance after cleaning. In addition, it is believed advantageous to provide a cleaning composition which is substantially free of organic solvents.

SUMMARY OF THE INVENTION

This invention provides aqueous formulations useful for cleaning soiled or stained fabric or for imparting soil and stain protection to newly-manufactured carpet.

Aqueous formulations of the present invention comprise: 4 to 270 grams (or 1.3 to 270 grams on a 100% active ingredient basis) of detergent per gallon of formulation; 0.04 to 133 grams (or 0.009 to 60 grams on a 100% active ingredient basis) of a fluorochemical soil-resist agent per gallon of formulation; 0.7 to 536 grams (or 0.2 to 134 grams on a 100% active ingredient basis) of a stain-resist agent per gallon of formulation; and 0.04 to 133 grams (or 0.01 to 53 grams on a 100% active ingredient basis) of inorganic particulate matter selected from the group consisting of clays, colloidal silica, colloidal alumina, titanium dioxide, and mixtures thereof. The detergent may contain an anionic, cationic, amphoteric, or nonionic surfactant. Preferred detergents include a mixture of sodium tripolyphosphate and sodium sesquicarbonate; or a mixture of sodium lauryl sulfate, sodium hexadecyl sulfate and sodium tetradecyl sulfate. The stain-resist agent may be selected from the group consisting of copolymers of hydrolyzed maleic anhydride with aliphatic alpha olefins, aromatic olefins, or vinyl ethers, homopolymers of methacrylic acid, and copolymers of methacrylic acid. In one preferred formulation, the detergent is a mixture of sodium tripolyphosphate and sodium sesquicarbonate, and the inorganic particulate matter is colloidal silica. In another preferred formulation, the detergent is a mixture of sodium lauryl sulfate, sodium hexadecyl sulfate and sodium tetradecyl sulfate, and the inorganic particulate matter is colloidal silica.

This invention also includes concentrates suitable for making an aqueous formulation comprising (a) a surfactant, (b) a fluorochemical soil-resist agent, (c) a stain-resist agent, and (d) inorganic particulate matter selected from the group consisting of clays, colloidal silica, colloidal alumina, titanium dioxide, and mixtures thereof, whereby the concentrate is capable of being diluted with an appropriate amount of water to produce an aqueous formulation having a concentration of: 4 to 270 grams (or 1.3 to 270 grams on a 100% active ingredient basis) of detergent per gallon of formulation; 0.04 to 133 grams (or 0.009 to 60 grams on a 100% active ingredient basis) of a fluorochemical soil-resist agent per gallon of formulation; 0.7 to 536 grams (or 0.2 to 134 grams on a 100% active ingredient basis) of a stain-resist agent per gallon of formulation; and 0.04 to 133 grams (or 0.01 to 53 grams on a 100% active ingredient basis) of inorganic particulate matter selected from the group consisting of clays, colloidal silica, colloidal alumina, titanium dioxide, and mixtures thereof. The detergent may contain an anionic, cationic, amphoteric, or nonionic surfactant. Preferred detergents include a mixture of sodium tripolyphosphate and sodium sesquicarbonate; or a mixture of sodium lauryl sulfate, sodium hexadecyl sulfate and sodium tetradecyl sulfate. The stain-resist agent in the concentrate may be a compound selected from the group consisting of copolymers of hydrolyzed maleic anhydride with aliphatic alpha olefins, aromatic olefins, or vinyl ethers, homopolymers of methacrylic acid, and copolymers of methacrylic acid. In one preferred concentrate, the detergent is a mixture of sodium tripolyphosphate and sodium sesquicarbonate, and the inorganic particulate matter is colloidal silica. In another preferred concentrate, the detergent is a mixture of sodium lauryl sulfate, sodium hexadecyl sulfate and sodium tetradecyl sulfate, and the inorganic particulate matter is colloidal silica.

This invention also includes methods for protecting newly manufactured fabrics or for cleaning textile fabrics comprising fibers having soil on the fiber surfaces. The steps involved in such methods comprise contacting the fibers with an aqueous formulation comprising a detergent, a fluorochemical soil-resist agent, a stain-resist agent, and inorganic particulate matter selected from the group consisting of clays, colloidal silica, colloidal alumina, titanium dioxide, and mixtures thereof in a concentration of: (a) 0.07 to 5% (or 0.02 to 5% on a 100% active ingredient basis) of detergent based on weight of fiber; (b) 0.0008 to 10% (or 0.0002 to 4.0% on a 100% active ingredient basis) of fluorochemical soil-resist agent based on weight of fiber; (c) 0.01 to 15% (or 0.0025 to 3.75% on a 100% active ingredient basis) of stain-resist agent based on weight of fiber; and (d) 0.0008 to 10% (or 0.0003 to 4.0% on a 100% active ingredient basis) of inorganic particulate matter based on weight of fiber in such a manner that at least some of the soil on the fiber surfaces is loosened, followed by removing at least some of the loosened soil. The above-described aqueous formulations with the specified detergents, fluorochemical soil-resist agents, stain-resist agents, and inorganic particulate matter may be used in such methods.

In formulations in accordance with this invention (including the concentrate form) the detergent, the fluorochemical soil-resist agent, the stain-resist agent and the inorganic particulate matter used in the formulations and in the concentrate each have a flash point that is at least 100° C.

In a preferred hot water extraction method, the fibers of the fabric are contacted with the aqueous cleaning formulation by spraying the formulation having a temperature in the range of room temperature to 160° F. onto the fibers. In other methods, the cleaning formulation may be foam applied or applied with a device such as a wetted pad or brush. The textile fabric to be cleaned may be selected from a variety of fabric materials such as upholstery or carpets, particularly nylon carpets.

DETAILED DESCRIPTION OF THE INVENTION

The textile fabric cleaning compositions of this invention contain a) detergent, b) fluorochemical soil-resist agent, c) stain-resist agent, and d) a stable aqueous dispersion of inorganic particulate matter selected from the group consisting of clay, colloidal silica, colloidal alumina, titanium dioxide, and mixtures thereof.

By "detergent", it is meant compositions which reduce the surface tension of water; specifically, a surface-active agent which concentrates at oil-water interfaces, exerts emulsifying action, and thus aids in removing soils. Preferably, the detergent contains one or more surfactants (which may be hydrocarbon or fluorocarbon) to provide greater cleaning strength. These surfactants include anionic, cationic, amphoteric or nonionic surfactants or a mixture thereof. Such compounds as alkyl sulfonates, phosphates, glycols, and the like are typically used. Sodium lauryl sulfate, and sodium tripolyphosphate/sodium sesquicarbonate aqueous solutions are preferred detergents. A particularly preferred detergent is a mixture of about 90–95% by weight sodium tripolyphosphate and about 5–10% by weight sodium sesquicarbonate. Such a mixture is available from Stanley Steemer as Stanley Steemer Carpet Cleaner SS-76, hereinafter referred to as "SS-76". An aqueous solution comprising a mixture of sodium lauryl sulfate, sodium hexadecyl and sodium tetradecyl sulfate (available from Witco as DuPanol WAQE) is also an effective detergent. The detergents of this invention may also contain detergent builders such as ethylenediaminetetraacetic acid (EDTA).

By "fluorochemical soil-resist agent" it is meant compositions which resist or repel dirt, oil, or other substances not normally intended to be present on a substrate such as a textile material. Fluorochemical soil-resist agents may include polymers or compounds having pendent or end groups of perfluoroalkyl moieties, fluorosurfactants, or fluoro-intermediates. Examples of some suitable fluorochemical soil-resist agents include Zonyl 7950 and Zonyl 5180 (available from DuPont).

By "stain-resist agent" it is meant chemicals which impart partial or total resistance to staining. Staining is defined as discoloration due to a material adding color (such as food or liquid) that exhibits resistance to removal by standard cleaning methods. Stain-resist agents may include compounds such as hydrolyzed maleic anhydride co- or terpolymers with aliphatic alpha olefins, aromatic olefins or vinyl ethers, and homo- or copolymers of methacrylic acid. Preferably, the stain-resist agent is Zelan 338 which is available from DuPont.

By "inorganic particulate matter" it is meant compounds selected from the group consisting of clays, colloidal silica, colloidal alumina, titanium dioxide and combinations thereof. Colloidal silica such as Ludox HS-40 (available from DuPont) is especially preferred.

The relative amounts of detergent, fluorochemical soil-resist agent, stain-resist agent, and stable aqueous dispersion of inorganic particulate matter in the cleaning formulations of this invention vary depending on the chemicals used. Generally, the formulation comprises:

(a) 0.07 to 5% based on weight of fiber (% owf) of detergent;

(b) 0.0008 to 10% owf of fluorochemical soil-resist agent;

(c) 0.01 to 15% owf of stain-resist agent; and (d) 0.0008 to 10% owf of inorganic particulate matter.

The above ranges for the chemical components of the formulation are based on the components as-delivered. With as-delivered components, the active ingredient in the components may be less than 100%. On a 100% active ingredient basis, the cleaning formulation comprises:

(a) 0.02 to 5.0% on weight of fiber (% owf) of detergent;

(b) 0.0002 to 4.5% owf of fluorochemical soil-resist agent;

(c) 0.0025 to 3.75% owf stain-resist agent; and (d) 0.0003 to 4.0% owf inorganic particulate matter.

Alternatively, the concentration of the components in the aqueous cleaning formulations of this invention may be expressed in terms of grams per gallon of cleaning formulation. Particularly, the formulation comprises:

(a) 4 to 270 grams (or 1.3 to 270 grams on a 100% active ingredient basis) of detergent per gallon of cleaning formulation;

(b) 0.04 to 133 grams (or 0.009 to 60 grams on a 100% active ingredient basis) of fluorochemical soil-resist agent per gallon of cleaning formulation;

(c) 0.7 to 536 grams (or 0.2 to 134 grams on a 100% active ingredient basis) of stain-resist agent per gallon of cleaning formulation; and (d) 0.04 to 133 grams (or 0.01 to 53 grams on a 100% active ingredient basis) of inorganic particulate matter selected from the group consisting of clays, colloidal silica, colloidal alumina, titanium dioxide, and mixtures thereof.

The aqueous cleaning formulations of this invention may also contain other chemical agents known in the art such as fragrances, water softeners, pH buffers, and brighteners.

As described above, the aqueous cleaning formulations of this invention refer to the formulations as they are applied to textile fabrics such as carpets. It is recognized that cleaning concentrates suitable for making the aqueous cleaning formulations of this invention by dilution with water can also be made. These cleaning concentrates would then be provided to the carpet cleaner or other end-user. This invention also encompasses such cleaning concentrates. The cleaning concentrate comprises: (a) a detergent, (b) a fluorochemical soil-resist agent, (c) a stain-resist agent, and (d) inorganic particulate matter selected from the group consisting of clays, colloidal silica, colloidal alumina, titanium dioxide, and mixtures thereof, whereby the concentrate is capable of being diluted with an appropriate amount of water to produce an aqueous cleaning formulation having a concentration of:

(a) 4 to 270 grams (or 1.3 to 270 grams on a 100% active ingredient basis) of detergent per gallon of cleaning formulation;

(b) 0.04 to 133 grams (or 0.009 to 60 grams on a 100% active ingredient basis) of a fluorochemical soil-resist agent per gallon of cleaning formulation;

(c) 0.7 to 536 grams (or 0.2 to 134 grams on a 100% active ingredient basis) of a stain-resist agent per gallon of cleaning formulation; and (d) 0.04 to 133 grams (or 0.01 to 53 grams on a 100% active ingredient basis) of inorganic particulate matter.

Aqueous formulations of the present invention (including the concentrate form) are able to achieve a stable product formulation among incompatible components without the use of organic solvents. By "stable product formulation" it is meant an emulsion mixture which shows no substantial precipitation for a minimum of about six months.

That formulations of the present invention are able to combine water repellent fluorochemical emulsions with other water dispersible polymers and other inorganic additives into a stable formulation without the use of organic solvents is believed to be unexpected and surprising.

Aqueous formulations which are substantially free of organic solvents and contain components all of which have flash points of at least 100° C. (that is, equal to or greater than 100° C.) have important advantages, namely: (1) they minimize the contribution of the composition to volatile organic compounds (VOC); (2) they contribute to improved indoor air quality; (3) they are non-flammable; and (4) they reduce the potential for skin irritation.

The cleaning formulations of this invention effectively remove soil and many stains from textile fabrics and leave the fabric with an enhanced resistance to resoiling and restaining. Generally, the cleaning method involves contacting a textile fabric made of fibers with soil on the fiber surfaces, such as soiled upholstery or carpet, with the aqueous cleaning formulation in such a manner that at least some of the soil on the fiber surfaces is removed. A dispersion containing some of the loosened soil in the formulation may be formed. The loosened soil is removed by a suitable means such as vacuuming or padding. The preferred method for cleaning textile fabrics with the cleaning formulations of this invention is by hot water extraction. This method involves spraying the selected cleaning formulation having a temperature in the range of room temperature to 160° F. onto the fibers of the textile fabric. Alternatively, other cleaning methods may be used which include, but are not limited to, water extraction, foam cleaning, spin bonnet, and spot cleaning. In some methods, the cleaning formulation is applied by a wetted device such as a pad or brush. The best results occur when all loose soil and stain is removed by vacuuming or other means prior to application of the cleaning formulations.

It should be understood that in addition to cleaning previously soiled or stained carpet, the formulations of the present invention may be used to impart soil and stain protection to newly-manufactured, never-used carpet.

The following examples further illustrate the invention but should not be construed as limiting the scope of the invention.

TEST METHODS

Stain Performance After Carpet Cleaning

Carpets were cleaned with the cleaning formulations described in the following examples and allowed to completely dry. Each carpet was then stained with cherry flavored Kool-Aid for one hour, rinsed with tap water and dried. The carpets were then rated for stain-resistance using the AATCC test method 175 stain scale, where 1=severely stained and 10=no staining.

Soil Performance After Carpet Cleaning

The carpet samples were cleaned with the cleaning formulations as described in the following examples and allowed to completely dry. Unless otherwise indicated in the examples, each carpet was then subjected to the accelerated soiling procedure described below, and the Delta E was measured. The Delta E was measured using a Minolta Chroma Meter CR-210. The standard (target) used for making each Delta E measurement was a new, unused "as-is" sample of the carpet being tested. Color readings were taken at five different areas on the carpet sample and the average Delta E was reported. In measuring the Delta E, the standard (target) value of the new, unused, "as-is" carpet sample is first measured, and this value is stored in the memory of the Chroma Meter. The value of the soiled carpet is then measured by the Chroma Meter, and the Delta E is calculated therefrom. Delta E color deviation represents the total color difference. A lower Delta E value means the carpet resisted resoiling better than a carpet with a higher Delta E value.

Accelerated Soiling Procedure—A drum mill (on rollers) is used to tumble synthetic soil onto the carpet. Synthetic soil is prepared as described in AATCC Test Method 123-1995, Section 8. The synthetic soil contains 38% dark peat moss, 17% Portland cement, 17% kaolin clay, 17% 200 mesh silica, 1.75% carbon black (lamp or furnace black), 0.50% red iron oxide and 8.75% mineral oil (medicinal grade). All percentages are weight percent based on total weight of the soil.

Preparation of soil-coated beads—Place 30 grams of synthetic soil and 1 liter of clean nylon resin beads (Surlyn* ionomer resin beads ⅛"–3/16" diameter) into a clean, empty canister. Close the canister lid. Seal with duct tape and rotate the canister on rollers for 5 minutes. Remove the soil-coated beads from the canister.

Preparation of carpet samples to insert into the drum—Total sample size was 8"×25" for these tests. One test item and one control item are tested at the same time. The carpet pile of all samples must lay in the same direction. Cut the 8" side of the carpets in the machine direction (with the tuft rows).

In order to soil the carpet samples, place strong adhesive tape on the back side of the carpet pieces to hold them together. Place the carpet samples in the clean, empty drum mill with the tufts facing toward the center of the drum. The carpet is held in place in the drum mill with rigid wires. Place 250 cc of soil-coated resin beads and 250 cc of ball bearings (5/16" diameter) into the drum mill. Close the drum mill lid and seal with duct tape. Run the drum on the rollers for 2½ minutes at 105 rpm. Stop the rollers and reverse the direction of the drum mill. Run the drum on the rollers for an additional 2½ minutes at 105 rpm. Remove the carpet samples. Vacuum the carpet uniformly to remove excess dirt. Discard the soil-coated beads.

EXAMPLES

Although all the examples below illustrate the use of the textile fabric cleaning compositions of this invention in cleaning carpets, it will be readily recognized by one skilled in the art that the cleaning formulations of this invention have utility in cleaning other textile fabrics such as upholstery. In all the examples, cleaning was by hot water extraction.

The cleaning formulations shown in Table I were prepared and used in the examples. All weights of chemical components (detergent, soil-resist agent, stain-resist agent, and colloidal metal complex) shown in Table I are in grams per liter of formulation. Water was used as the solvent.

TABLE I (Grams/Liter of Aqueous Cleaning Formulation)

| Formulation | Detergent | Soil Resist | Stain Resist | Colloidal Metal Complex |
|---|---|---|---|---|
| Control A | 1.1 g SS-76 | — | — | — |
| Control B | 1.1 g SS-76 | 70.5 g ZONYL 7950 | 140.8 g ZELAN 338 | — |
| Sample 1 | 1.1 g SS-76 | 35.2 g ZONYL 7950 | 140.8 g ZELAN 338 | 133 g LUDOX HS-40 |
| Sample 2 | 1.1 g SS-76 | 52.8 g ZONYL 7950 | 211.3 g ZELAN 338 | 52.8 g LUDOX HS-40 |
| Sample 3 | 1.1 g SS-76 | 26.4 g ZONYL 7950 | 105.6 g ZELAN 338 | 26.4 g LUDOX HS-40 |
| Sample 4 | 1.1 g SS-76 | 52.8 g ZONYL 5180 | 211.3 g ZELAN 338 | 52.8 g LUDOX HS-40 |
| Control C | 1.1 g SS-76 | — | 140.8 g ZELAN 338 | 35.2 g LUDOX HS-40 |
| Control D | 1.1 g sodium lauryl sulfate | — | — | — |
| Sample 5 | 1.1 g sodium lauryl sulfate | 35.5 g ZONYL 7950 | 140.8 g ZELAN 338 | 35.5 g LUDOX HS-40 |

Example 1

The carpet used in this example was a new, never used beige level loop commercially available carpet (26 oz./sq. yd.) having a nylon 6,6 face fiber. The carpet did not have any fluorochemical or stain-resist treatment prior to being cleaned.

Carpets were cleaned with control cleaning formulations and cleaning formulations of this invention. After cleaning, the carpets were stained and their ability to resist stains measured according to the test method. Results are shown in Table II.

TABLE II

| Formulation | Stain Rating |
|---|---|
| Control A | 2 |
| Control B | 7 |
| Sample 1 | 7 |

The stain rating of carpets cleaned with the formulations of this invention (Sample 1) is at least as good as the rating of carpets cleaned with the prior art fabric cleaning formulation containing fluorochemical and stain-resist, but no colloidal metal complex (Control B). Both formulations provide much better stain-resistance than Control A (detergent with no fluorochemical or stain-resist additives).

A second set of carpets were cleaned with control and cleaning formulations of this invention and then the carpets were subjected to an accelerated soiling test as described in the above test methods. Results are shown in Table III.

TABLE III

Soiling Performance
DE of Carpet Treated with Control and
Test Formulation Samples vs. New Carpet

| Formulation: | Control A | Control B | Sample 1 |
|---|---|---|---|
| | 19.1 | 15.2 | |
| | 16.4 | | 7.3 |

The carpets cleaned with the formulation of this invention (Sample 1) soiled significantly less (smaller delta E) than carpets cleaned with the Control A.

Example 2

The effect of carpet construction (including pretreatments with stain or soil-resists) on the ability of the cleaning formulations of this invention to prevent re-soiling was determined in this example. Three different carpets were used: "Carpet A" was a light beige level loop commercial carpet having nylon 6,6 face fiber and treated by the mill with a topical fluorochemical soil-resist. "Carpet B" was a yellow cut pile commercial carpet having nylon 6,6 face fiber and treated with a topical fluorochemical soil-resist by the mill. "Carpet C" was a light beige level loop commercial carpet having nylon 6,6 solution dyed face fiber and was not treated by the mill with a fluorochemical soil-resist. Results of the accelerated soiling test are shown in Table IV.

TABLE IV

Soiling Performance
DE of Carpet Treated with Control and
Test Formulation Samples vs. New Carpet

| Formulation: | Control A | Sample 2 | Sample 3 | Sample 4 |
|---|---|---|---|---|
| Carpet A | | | | |
| | 12.1 | 6.4 | | |
| | 11.3 | | 6.7 | |
| | 11.5 | | | 6.6 |

TABLE IV-continued

| Formulation: | Control A | Sample 2 | Sample 3 | Sample 4 |
|---|---|---|---|---|
| | Soiling Performance DE of Carpet Treated with Control and Test Formulation Samples vs. New Carpet | | | |
| Carpet B | | | | |
| | 30.7 | 18.1 | | |
| | 35.3 | | 19.9 | |
| | 32.1 | | | 18.0 |
| Carpet C | | | | |
| | 13.9 | 5.9 | | |
| | 12.5 | | 5.9 | |
| | 11.7 | | | 6.6 |

Carpets cleaned with the cleaning formulations of this invention (Samples 2–4) recoiled significantly less than carpets cleaned with the control formulation. The improvement in resoiling using the formulations of this invention was evident regardless of whether the carpet had originally been treated with fluorochemical prior to cleaning.

Example 3

The necessity for having a fluorochemical soil-resist in the cleaning formulations of this invention was demonstrated in this example.

Yellow level loop commercial carpet (26 oz./sq. yd.) having a nylon 6,6 face fiber which had not been treated with fluorochemical stain-resist by the mill was used in this example. Carpet was subjected to the accelerated soiling procedure and soil performance test method described above. Results are contained in Table V.

TABLE V

| Formulation: | Control A | Sample 1 | Control C |
|---|---|---|---|
| | Soiling Performance DE of Carpet Treated with Control and Test Formulation Samples vs. New Carpet | | |
| | 54.4 | 12.1 | |
| | 52.9 | | 28.2 |

Control C contained a stain-resist agent and a colloidal metal complex, but no fluorochemical soil-resist. Its ability to prevent resoiling was significantly worse (delta E=28.2) than a formulation of this invention (Sample 1) which contained fluorochemical soil-resist, stain-resist and colloidal metal complex (delta E=12.1)

Example 4

The effect of changing detergent type (sodium lauryl sulfate mixture vs. sodium tripolyphosphate/sodium sesquicarbonate) on restaining and resoiling was investigated in this example. New pieces of the same carpet used in Example 3 were used in this example. The results of the stain test are contained in Table VI and the resoiling test are contained in Table VII.

TABLE VI

| Formulation | Stain Rating |
|---|---|
| Stain Performance After Cleaning | |
| Control A | 1 |
| Control D | 1 |
| Sample 5 | 9 |

TABLE VII

| Formulation: | Control A | Control D | Sample 5 |
|---|---|---|---|
| | Soiling Performance After Cleaning DE of Carpet Treated with Control and Test Formulation Samples vs. New Carpet | | |
| | 53.7 | | 14.5 |
| | | 52.2 | 13.4 |

The cleaning formulations of this invention perform just as well in the stain test and soiling test regardless of whether the detergent is sodium tripolyphosphate/sodium sesquicarbonate or sodium lauryl sulfate mixture.

Example 5

This example measured the effect of cleaning formulations of this invention on the resoiling of nylon 6 carpets. The carpet used was a light gray commercial level loop style carpet having nylon 6 face fiber. The face fiber had been treated with a fluorochemical soil-resist by the mill. Rather than using the accelerated soiling procedure described in the test method, carpet was first trafficked in a busy corridor of an office building for 260,000 human foot traffics. The carpet was then cleaned with a control cleaning formulation and a cleaning formulation of this invention and then exposed to an additional 91,000 human foot traffics. The resoiling performance is shown in Table VIII.

TABLE VIII

| Formulation: | Control A | Sample 1 |
|---|---|---|
| | Soiling Performance After Cleaning DE of Carpet Treated with Control and Test Formulation Samples vs. New Carpet | |
| | 13.0 | 8.0 |

Thus the cleaning formulations of this invention work on nylon 6 carpets as well as nylon 6,6 carpets to prevent resoiling.

Example 6

The minimum useful level of ingredients was determined in this example.

The carpet used in this example was new, never used yellow level loop commercial carpet (26 oz/sq.yd.) having a nylon 6,6 face fiber. The carpet did not have any fluorochemical or stain-resist treatment prior to being cleaned.

Carpets were cleaned with control cleaning formulation and cleaning formulations of this invention. After cleaning, the carpets were stained and their ability to resist stains was measured according to the test method. The stain rating of carpets 442-2, 430-6, 430-5, 430-4, 430-3, 430-2, 404-6, 404-5, 404-4, 404-3, and 404-2 were better than control.

These carpets were also subjected to an accelerated soiling test as described in the above methods. The carpets cleaned with the formulations of this invention soiled significantly less (smaller delta E) than carpets cleaned with the control. Restain and resoil data are contained in TABLE IX.

TABLE IX

| | (Grams/Liter of Formulation) | | | | DELTA E DRUM SOIL | | 1 HR KOOL-AID |
|---|---|---|---|---|---|---|---|
| ITEM | SS-76 | ZONYL 7950 | LUDOX HS-40 | ZELAN 338 | CONT SS-76 | TEST ITEM | STAIN-TEST |
| Control A | 1.1 | | | | | | 1 |
| 404-2 | 1.1 | 35.2 | 35.2 | 140.8 | 54.4 | 12.1 | 4.5 |
| 404-3 | 1.1 | 17.6 | 17.6 | 70.4 | 56.2 | 13.9 | 4 |
| 404-4 | 1.1 | 8.8 | 8.8 | 35.2 | 55.9 | 17.5 | 4 |
| 404-5 | 1.1 | 4.4 | 4.4 | 17.6 | 58.5 | 21.5 | 3.5 |
| 404-6 | 1.1 | 2.2 | 2.2 | 8.8 | 54.1 | 22.2 | 3.5 |
| 430-2 | 1.1 | 1.7 | 1.7 | 6.6 | 48.3 | 20.3 | 2.5 |
| 430-3 | 1.1 | 0.8 | 0.8 | 3.3 | 49.5 | 32.5 | 2.5 |
| 430-4 | 1.1 | 0.4 | 0.4 | 1.7 | 50.7 | 38.8 | 2.5 |
| 430-5 | 1.1 | 0.2 | 0.2 | 0.8 | 50.4 | 44.4 | 2 |
| 430-6 | 1.1 | 0.1 | 0.1 | 0.4 | 51.0 | 47.7 | 2 |
| 442-2 | 1.1 | 0.05 | 0.05 | 0.2 | 58.4 | 49.3 | 1.5 |
| 442-3 | 1.1 | 0.025 | 0.025 | 0.1 | 57.2 | 54.4 | 1 |
| 442-4 | 1.1 | 0.013 | 0.013 | 0.05 | 59.0 | 56.3 | 1 |

We claim:

1. An aqueous formulation comprising:

(a) 4 to 270 grams of a detergent per gallon of formulation, (b) 0.04 to 133 grams of a fluorochemical soil-resist agent per gallon of formulation,;

(c) 0.7 to 536 grams of a stain-resist agent per gallon of formulation, and (d) 0.04 to 133 grams of inorganic particulate matter selected from the group consisting of clays, colloidal silica, colloidal alumina, titanium dioxide, and mixtures thereof per gallon of cleaning formulation, wherein the formulation is substantially free of organic solvents.

2. An aqueous formulation comprising:

(a) 1.3 to 270 grams of a detergent per gallon of formulation, (b) 0.009 to 60 grams of a fluorochemical soil-resist agent per gallon of formulation;

(c) 0.2 to 134 grams of a stain-resist agent per gallon of formulation, and (d) 0.01 to 53 grams of inorganic particulate matter selected from the group consisting of clays, colloidal silica, colloidal alumina, titanium dioxide, and mixtures thereof per gallon of cleaning formulation, wherein the formulation is substantially free of organic solvents.

3. The aqueous formulation of claim 1 or 2, wherein the detergent comprises an anionic, cationic, amphoteric, or nonionic surfactant.

4. The aqueous formulation of claim 3, wherein the detergent is selected from the group consisting of a mixture of sodium tripolyphosphate and sodium sesquicarbonate; and a mixture of sodium lauryl sulfate, sodium hexadecyl sulfate, and sodium tetradecyl sulfate.

5. The aqueous formulation of claim 1 or 2, wherein the stain-resist agent is a compound selected from the group consisting of copolymers of hydrolyzed maleic anhydride with aliphatic alpha olefins, aromatic olefins, or vinyl ethers, homopolymers of methacrylic acid, and copolymers of methacrylic acid.

6. The aqueous formulation of claim 4, wherein the detergent is a mixture of sodium tripolyphosphate and sodium sesquicarbonate, and the inorganic particulate matter is colloidal silica.

7. The aqueous formulation of claim 4, wherein the detergent is a mixture of sodium lauryl sulfate, sodium hexadecyl sulfate, and sodium tetradecyl sulfate, and the inorganic particulate matter is colloidal silica.

8. A concentrate suitable for making an aqueous formulation comprising: (a) a detergent, (b) a fluorochemical soil-resist agent, (c) a stain-resist agent, and (d) inorganic particulate matter selected from the group consisting of clays, colloidal silica, colloidal alumina, titanium dioxide, and mixtures thereof, whereby the concentrate is capable of being diluted with an appropriate amount of water to produce an aqueous formulation having a concentration of:

4 to 270 grams of a detergent per gallon of formulation;

0.04 to 133 grams of a fluorochemical soil-resist agent per gallon of formulation;

0.7 to 536 grams of a stain-resist agent per gallon of formulation; and 0.04 to 133 grams of inorganic particulate matter per gallon of formulation;

wherein the formulation is substantially free of organic solvents.

9. A concentrate suitable for making an aqueous formulation comprising: (a) a detergent, (b) a fluorochemical soil-resist agent, (c) a stain-resist agent, and (d) inorganic particulate matter selected from the group consisting of clays, colloidal silica, colloidal alumina, titanium dioxide, and mixtures thereof, whereby the concentrate is capable of being diluted with an appropriate amount of water to produce an aqueous formulation having a concentration of:

1.3 to 270 grams of a detergent per gallon of formulation;

0.009 to 60 grams of a fluorochemical soil-resist agent per gallon of formulation;

0.2 to 134 grams of a stain-resist agent per gallon of formulation; and 0.01 to 53 grams of inorganic particulate matter per gallon of formulation;

wherein the formulation is substantially free of organic solvents.

10. The concentrate of claim 8 or 9, wherein the detergent comprises an anionic, cationic, amphoteric, or nonionic surfactant.

11. The concentrate of claim 10, wherein the detergent is selected from the group consisting of a mixture of sodium tripolyphosphate and sodium sesquicarbonate; and a mixture of sodium lauryl sulfate, sodium hexadecyl sulfate and sodium tetradecyl sulfate.

12. The concentrate of claim 8 or 9, wherein the stain-resist agent is a compound selected from the group consisting of copolymers of hydrolyzed maleic anhydride with aliphatic alpha olefins, aromatic olefins, or vinyl ethers, homopolymers of methacrylic acid, and copolymers of methacrylic acid.

13. The concentrate of claim 8 or 9, wherein the detergent is a mixture of sodium tripolyphosphate and sodium sesquicarbonate, and the inorganic particulate matter is colloidal silica.

14. The concentrate of claim 8 or 9, wherein the detergent is a mixture of sodium lauryl sulfate, sodium hexadecyl sulfate and sodium tetradecyl sulfate, and the inorganic particulate matter is colloidal silica.

15. A method for cleaning a textile fabric comprising fibers having soil on the surface of the fibers, comprising the steps of:

(i) contacting the fibers with an aqueous cleaning formulation comprising a detergent, a fluorochemical soil-resist agent, a stain-resist agent, and inorganic particulate matter selected from the group consisting of clays, colloidal silica, colloidal alumina, titanium dioxide, and mixtures thereof in a concentration of:

(a) 0.07 to 5% of detergent based on weight of fiber;

(b) 0.0008 to 10% of fluorochemical soil-resist agent based on weight of fiber;

(c) 0.01 to 15% of stain-resist agent based on weight of fiber; and (d) 0.0008 to 10% of inorganic particulate matter based on weight of fiber in such a manner that at least some of the soil is loosened;

wherein the formulation is substantially free of organic solvents; and (ii) removing at least some of the loosened soil.

16. A method for cleaning a textile fabric comprising fibers having soil on the surface of the fibers, comprising the steps of:

(i) contacting the fibers with an aqueous cleaning formulation comprising a detergent, a fluorochemical soil-resist agent, a stain-resist agent, and inorganic particulate matter selected from the group consisting of clays, colloidal silica, colloidal alumina, titanium dioxide, and mixtures thereof in a concentration of:

(a) 0.02 to 5% of detergent based on weight of fiber;

(b) 0.0002 to 4.5% of fluorochemical soil-resist agent based on weight of fiber;

(c) 0.0025 to 3.75% of stain-resist agent based on weight of fiber, and (d) 0.0003 to 4.0% of inorganic particulate matter based on weight of fiber in such a manner that at least some of the soil is loosened, wherein the formulation is substantially free of organic solvents; and (ii) removing at least some of the loosened soil.

17. The method of claim 15 or 16, wherein the detergent in the cleaning formulation comprises an anionic, cationic, amphoteric, or nonionic surfactant.

18. The method of claim 17, wherein the detergent is selected from the group consisting of a mixture of sodium tripolyphosphate and sodium sesquicarbonate; and a mixture of sodium lauryl sulfate, sodium hexadecyl sulfate, and sodium tetradecyl sulfate.

19. The method of claim 15 or 16, wherein the stain-resist agent in the cleaning formulation is a compound selected from the group consisting of copolymers of hydrolyzed maleic anhydride with aliphatic alpha olefins, aromatic olefins, or vinyl ethers, homopolymers of methacrylic acid, and copolymers of methacrylic acid.

20. The method of claim 15 or 16, wherein the detergent in the cleaning formulation is a mixture of sodium tripolyphosphate and sodium sesquicarbonate, and the inorganic particulate matter is colloidal silica.

21. The method of claim 15 or 16, wherein the detergent in the cleaning formulation is a mixture of sodium lauryl sulfate, sodium hexadecyl sulfate, and sodium tetradecyl sulfate, and the inorganic particulate matter is colloidal silica.

22. The method of claim 15 or 16, wherein the fibers are contacted with the aqueous cleaning formulation by spraying the formulation having a temperature in the range of room temperature to 160° F. onto the fibers.

23. The method of claim 15 or 16, wherein the fibers are contacted with the aqueous cleaning formulation by foaming the formulation onto the fibers.

24. The method of claim 15 or 16, wherein the fibers are contacted with the aqueous cleaning formulation by contacting the fibers with a device containing with the formulation.

25. The method of claim 15 or 16, wherein the textile fabric is a carpet.

26. The method of claim 25, wherein the carpet is a nylon carpet.

27. A method for imparting soil and stain protection to a textile fabric comprising fibers, comprising the step of:

(i) contacting the fibers with an aqueous formulation comprising a detergent, a fluorochemical soil-resist agent, a stain-resist agent, and inorganic particulate matter selected from the group consisting of clays, colloidal silica, colloidal alumina, titanium dioxide, and mixtures thereof in a concentration of:

(a) 0.02 to 5% of detergent based on weight of fiber;

(b) 0.0002 to 4.5% of fluorochemical soil-resist agent based on weight of fiber;

(c) 0.0025 to 3.75% of stain-resist agent based on weight of fiber, and (d) 0.0003 to 4.0% of inorganic particulate matter based on weight of fiber in such a manner that at least some of the soil is loosened, wherein the formulation is substantially free of organic solvents.

* * * * *